US007784386B2

(12) United States Patent
Chan

(10) Patent No.: US 7,784,386 B2
(45) Date of Patent: Aug. 31, 2010

(54) PAPER CUTTING APPARATUS

(75) Inventor: Kwok Ki Stephen Chan, Hong Kong (HK)

(73) Assignee: Lee Tack Plastic & Metal Manufactory Ltd, New Territories (HK)

( * ) Notice: Subject to any disclaimer, the term of this patent is extended or adjusted under 35 U.S.C. 154(b) by 118 days.

(21) Appl. No.: 11/770,970

(22) Filed: Jun. 29, 2007

(65) Prior Publication Data

US 2009/0000439 A1 Jan. 1, 2009

(51) Int. Cl.
*B26D 1/62* (2006.01)

(52) U.S. Cl. ..... 83/343; 83/346

(58) Field of Classification Search ..... 83/331, 83/343, 344, 346, 347, 348; 492/45, 47, 492/48

See application file for complete search history.

(56) References Cited

U.S. PATENT DOCUMENTS

| | | | | | |
|---|---|---|---|---|---|
| 3,720,126 | A * | 3/1973 | Kranz | 83/344 |
| 4,374,573 | A * | 2/1983 | Rouse et al. | 241/101.76 |
| 4,625,612 | A * | 12/1986 | Oliver | 83/863 |
| 4,759,247 | A * | 7/1988 | Bell et al. | 83/346 |
| 4,982,639 | A * | 1/1991 | Kirkpatrick | 83/659 |
| 5,138,923 | A * | 8/1992 | Kent et al. | 83/665 |
| 5,189,935 | A * | 3/1993 | Rosemann | 83/343 |
| 5,647,260 | A * | 7/1997 | Nabity | 83/522.12 |
| 6,063,094 | A * | 5/2000 | Rosenberg | 83/678 |
| 6,520,896 | B1 * | 2/2003 | Sohl | 492/45 |

* cited by examiner

*Primary Examiner*—Stephen Choi
(74) *Attorney, Agent, or Firm*—William J. Sapone; Coleman Sudol Sapone P.C.

(57) ABSTRACT

A paper cutting apparatus is disclosed as including a cylindrical cutting roller with a number of closed-loop cutting ridges on its outer cylindrical surface and a support roller, in which the cutting roller is rotatable relative to the support roller to move a piece of paper or cardboard material relative to and between the cutting roller and support roller to cut out part of the piece of paper or cardboard material.

11 Claims, 9 Drawing Sheets

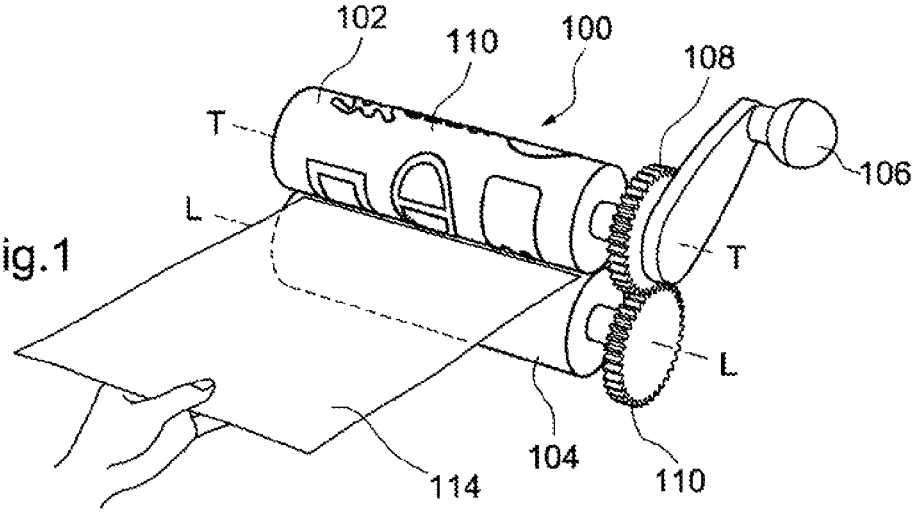
Fig.1
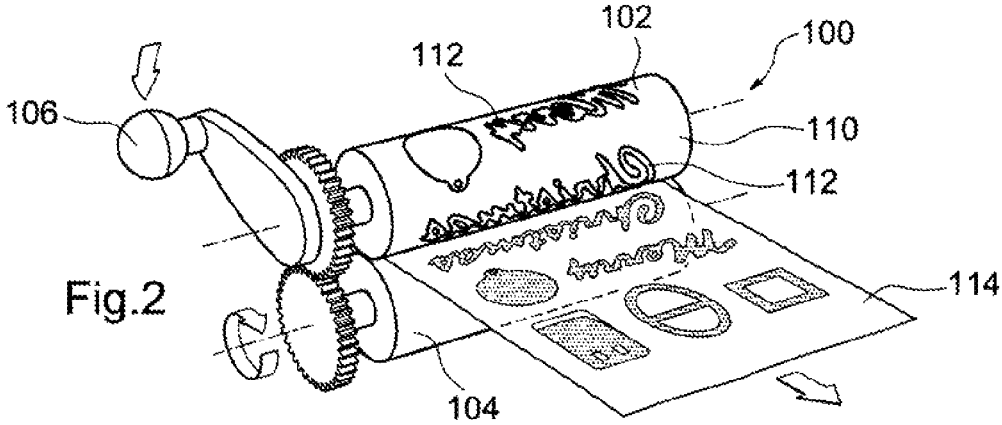
Fig.2
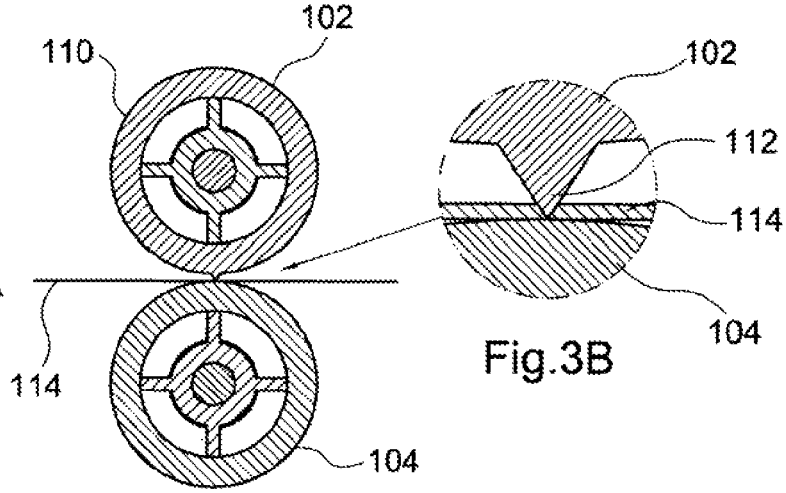
Fig.3A
Fig.3B

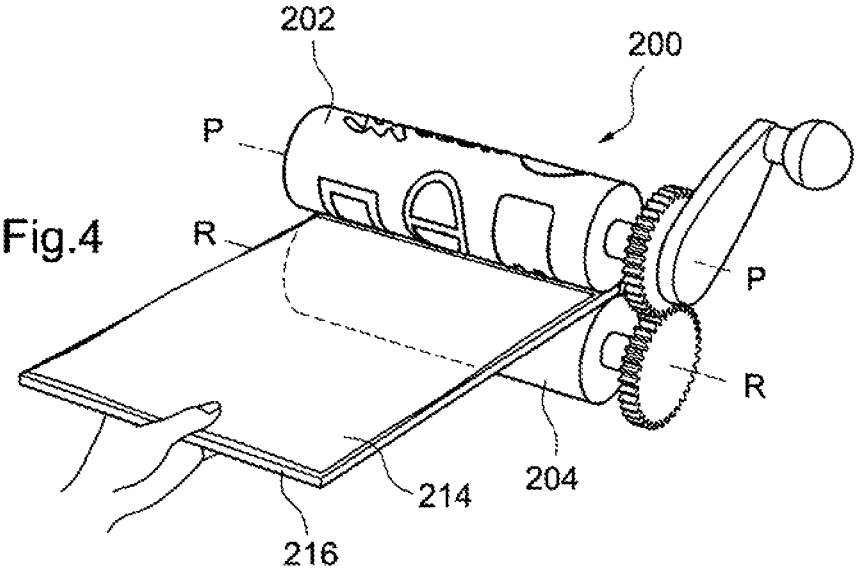
Fig.4
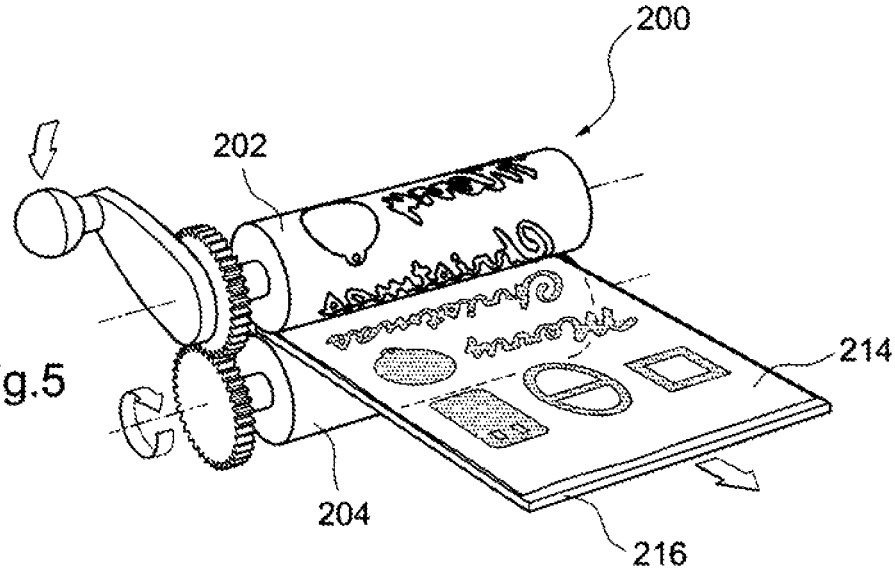
Fig.5
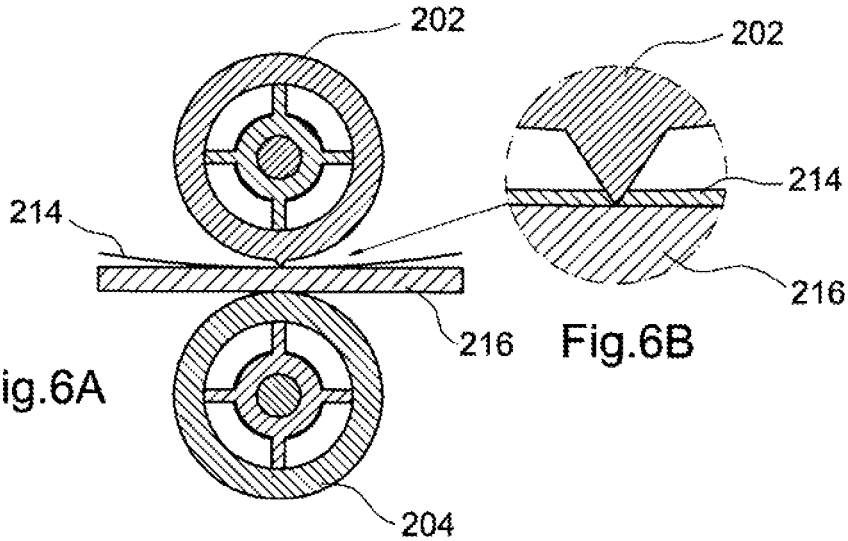
Fig.6A
Fig.6B

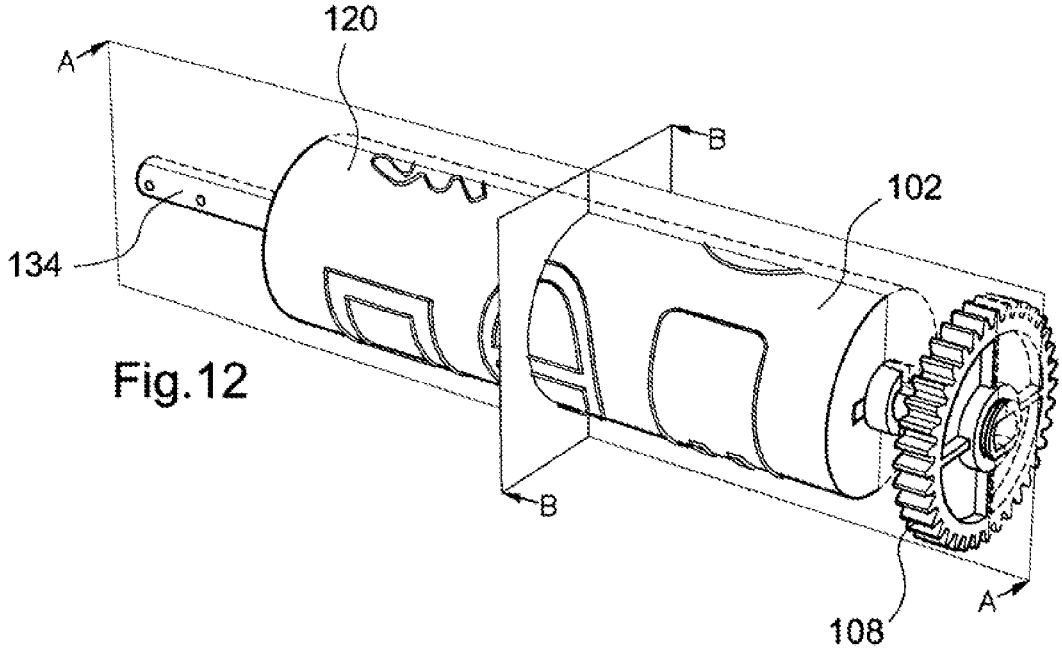
Fig.12
Fig.13B
Fig.13A
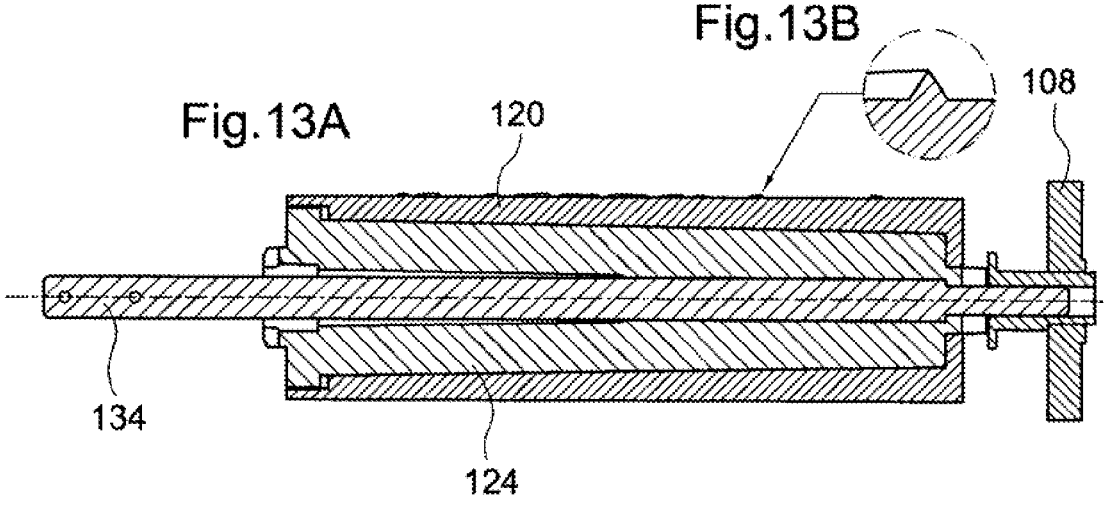
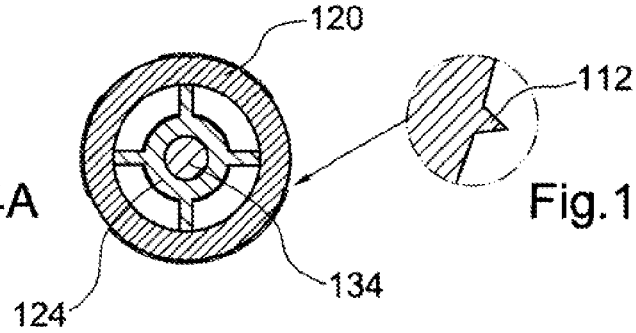
Fig.14A
Fig.14B

Fig.15
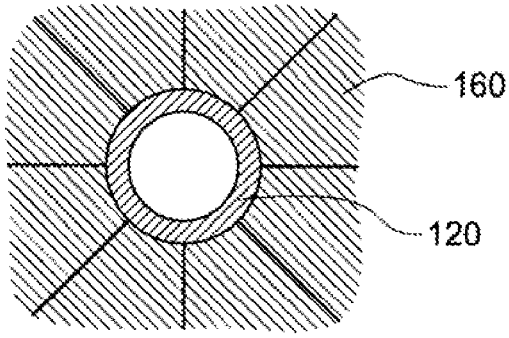
Fig.16
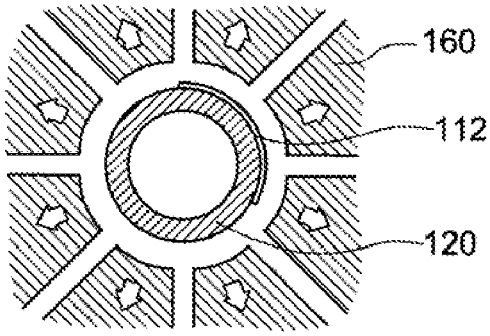
Fig.17
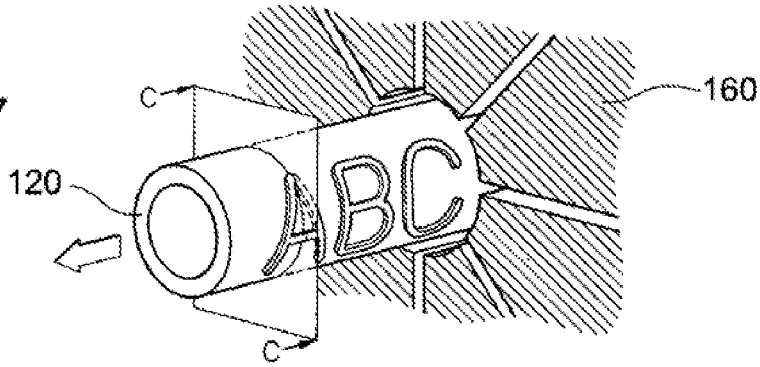
Fig.18A
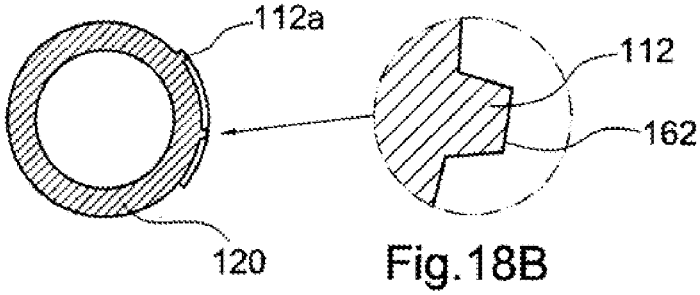
Fig.18B

PAPER CUTTING APPARATUS

This invention relates to a paper cutting apparatus, in particular such an apparatus adapted to cut out part of a piece of material, e.g. for paper craft purposes.

BACKGROUND OF THE INVENTION

Existing paper crafting apparatus for cutting paper or cardboard are mostly hand-operated punches. Such paper punches have a lever operatively associated with a body with a generally horizontal slot allowing insertion of a sheet of paper or cardboard. The lever may then be pivoted downwardly by a user to move a die to punch or cut out a piece of shaped paper or cardboard from the piece of paper or cardboard.

Such apparatus are generally speaking small in size and are not suitable for cutting out large-sized pieces of patterned paper or cardboard from a sheet of paper or cardboard material. Even if some larger-sized punches may be available, a user has to spend much force to operate such punches.

It is thus an object of the present invention to provide a paper cutting apparatus and a method of cutting out part of a piece of paper or cardboard material in which the aforesaid shortcomings are mitigated, or at least to provide a useful alternative to the public.

SUMMARY OF THE INVENTION

According to a first aspect of the present invention, there is provided a paper cutting apparatus including a cylindrical cutting member with at least one closed-loop cutting ridge on its outer cylindrical surface; and a support member; wherein said cutting member is rotatable relative to said support member to move a piece of paper or cardboard material relative to and between said cutting member and said support member to cut out part of said piece of material.

According to a second aspect of the present invention, there is provided a method of cutting out part of a piece of paper or cardboard material, including the steps of providing a cylindrical cutting member with at least one closed-loop cutting ridge on its outer cylindrical surface; providing a support member; and rotating said cutting member relative to said support member to move said piece of paper or cardboard material relative to and between said cutting member and said support member.

BRIEF DESCRIPTION OF THE DRAWINGS

Preferred embodiments of the present invention will now be described, by way of example only, with reference to the accompanying drawings, in which:

FIG. 1 shows positioning of a piece of paper to be cut by a paper cutting apparatus according to a first embodiment of the present invention;

FIG. 2 shows positioning of the piece of paper after being cut by the paper cutting apparatus of FIG. 1;

FIG. 3A shows engagement between the cutting roller and support roller of the apparatus of FIG. 1 with the paper for cutting;

FIG. 3B is an enlarged view showing the cutting action of FIG. 3A;

FIG. 4 shows positioning of a piece of paper to be cut by a paper cutting apparatus according to a second embodiment of the present invention;

FIG. 5 shows positioning of the piece of paper after being cut by the paper cutting apparatus of FIG. 4;

FIG. 6A shows engagement between the cutting roller and the support roller of the apparatus of FIG. 4 with the paper for cutting;

FIG. 6B is an enlarged view showing the cutting action of FIG. 6A;

FIG. 12 is a further perspective view of the cutting roller of the apparatus of FIG. 1;

FIG. 13 is a sectional view taken along the plane A-A in FIG. 12;

FIG. 14A is a sectional view taken along the plane B-B in FIG. 12;

FIG. 14B is an enlarged view of part of the outer surface of the cutting roller of FIG. 14A;

FIG. 15 shows a sectional view of a mould piece for manufacturing a cutting roller;

FIG. 16 shows a sectional view of a cutting roller formed in the mould piece;

FIG. 17 shows a perspective view of the cutting roller of FIG. 16 being released from the mould piece;

FIG. 18A is a sectional view taken along the plane C-C of FIG. 17;

FIG. 18B is an enlarged view of the cutting roller of FIG. 18A;

DETAILED DESCRIPTION OF THE PREFERRED EMBODIMENTS

Figure 7:
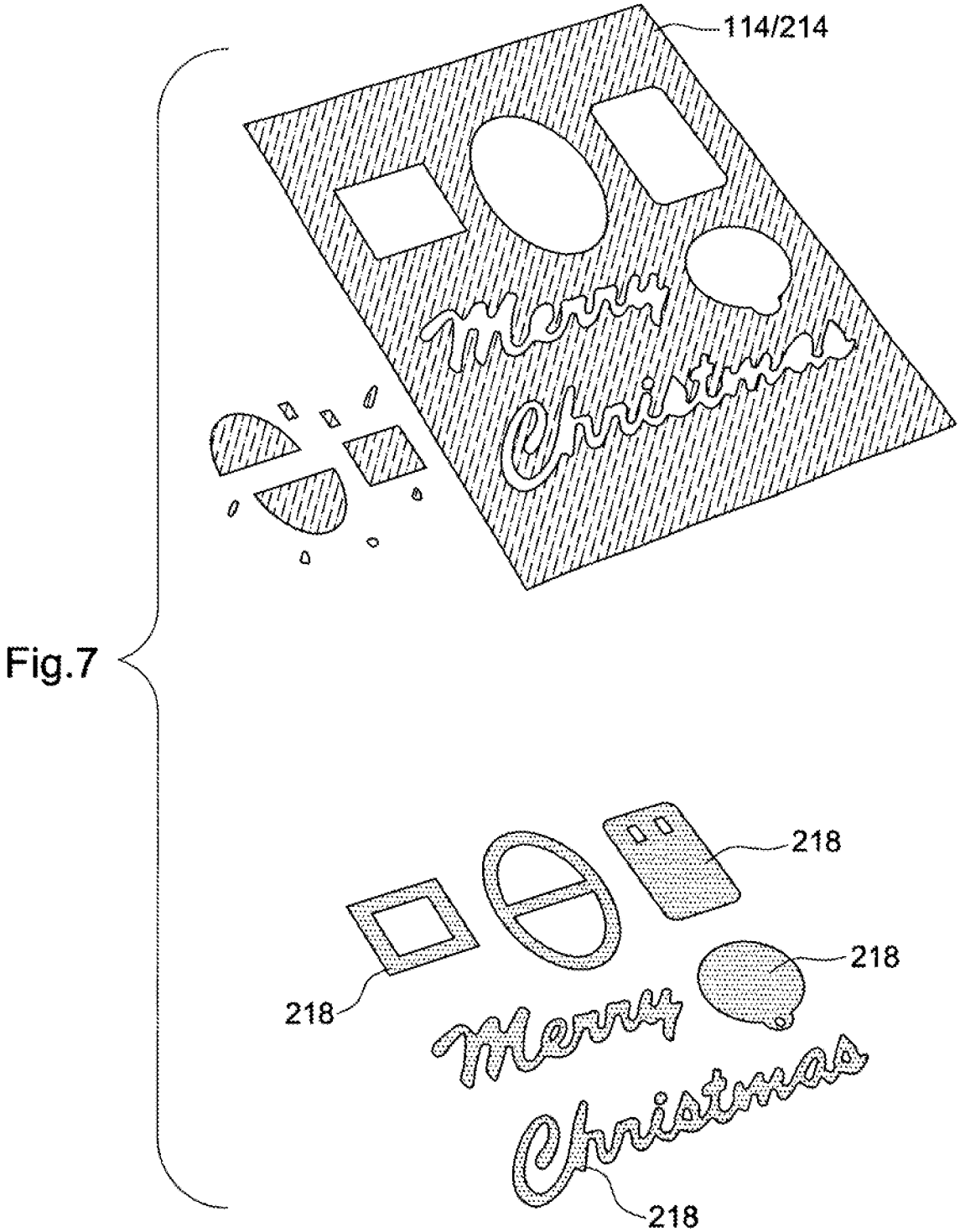
FIG. 7 shows the piece of paper after cutting.

Although the present invention will hereinafter be referred to as and described in the context of a paper cutting apparatus, it is envisaged that the present invention is also suitable for cutting cardboard and such like materials, and that the scope of protection should be construed accordingly.

FIGS. 1 and 2 show a paper cutting apparatus according to a first embodiment of the present invention, generally designated as 100. The apparatus 100 has an upper cylindrical cutting roller 102, which is made of a metal or metal alloy (e.g. a zinc alloy) and a lower cylindrical support roller 104 made of a plastics material. The upper cutting roller 102 is rotatable about an axis T-T and the lower support roller 104 is rotatable about an axis L-L. The axes T-T and L-L are parallel to each other, and lie on a same vertical plane.

In use, a user may rotate a handle 106 to rotate the cutting roller 102. As the cutting roller 102 is engaged with a gear 108 which is in mesh with a gear 110 engaged with the support roller 104, rotation of the cutting roller 102 will bring about simultaneous rotation of the support roller 104, although the rollers 102, 104 will rotate in two opposite directions.

An outer cylindrical surface 110 of the cutting roller 102 is provided with a number of continuous closed-loop patterned cutting ridges 112. The rollers 102, 104 are spaced slightly apart from each other to allow insertion of a piece of paper or cardboard 114 therebetween for cutting. Upon rotation of the rollers 102, 104, the piece of paper 114 will be caused to move relative to and between the rollers 102, 104. As shown more clearly in FIGS. 3A and 3B, when the piece of paper 114 thus passes between the rollers 102, 104, the cutting ridges 112 of the cutting roller 102 will cut into the paper 114, as backed up by the support roller 104.

FIGS. 4 and 5 show a paper cutting apparatus according to a second embodiment of the present invention, generally designated as 200. Similar to the apparatus 100, the apparatus 200 has an upper cylindrical cutting roller 202, which is made of a metal or metal alloy (e.g. a zinc alloy) and a lower cylindrical support roller 204 made of a metal or metal alloy. The upper cutting roller 202 is rotatable about an axis P-P and the lower support roller 204 is rotatable about an axis R-R. The axes p-p and R-R are parallel to each other, and lie on a same vertical plane.

A main difference between the apparatus 100 and the apparatus 200 is that, in the case of the apparatus 200, a piece of paper or cardboard 214 to be cut is placed on a plastics board 216 for support during cutting. As shown in FIGS. 6A and 6B, during the cutting process, the piece of paper 214 is in contact with the cutting roller 202 and the board 216 is in contact with the support roller 204.

As shown in FIG. 7, by operating the apparatus 100 or 200, the piece of paper 114 or 214 may be cut to form pieces of patterned paper or cardboard 218, which may be words, patterns or the like.

Figure 8:
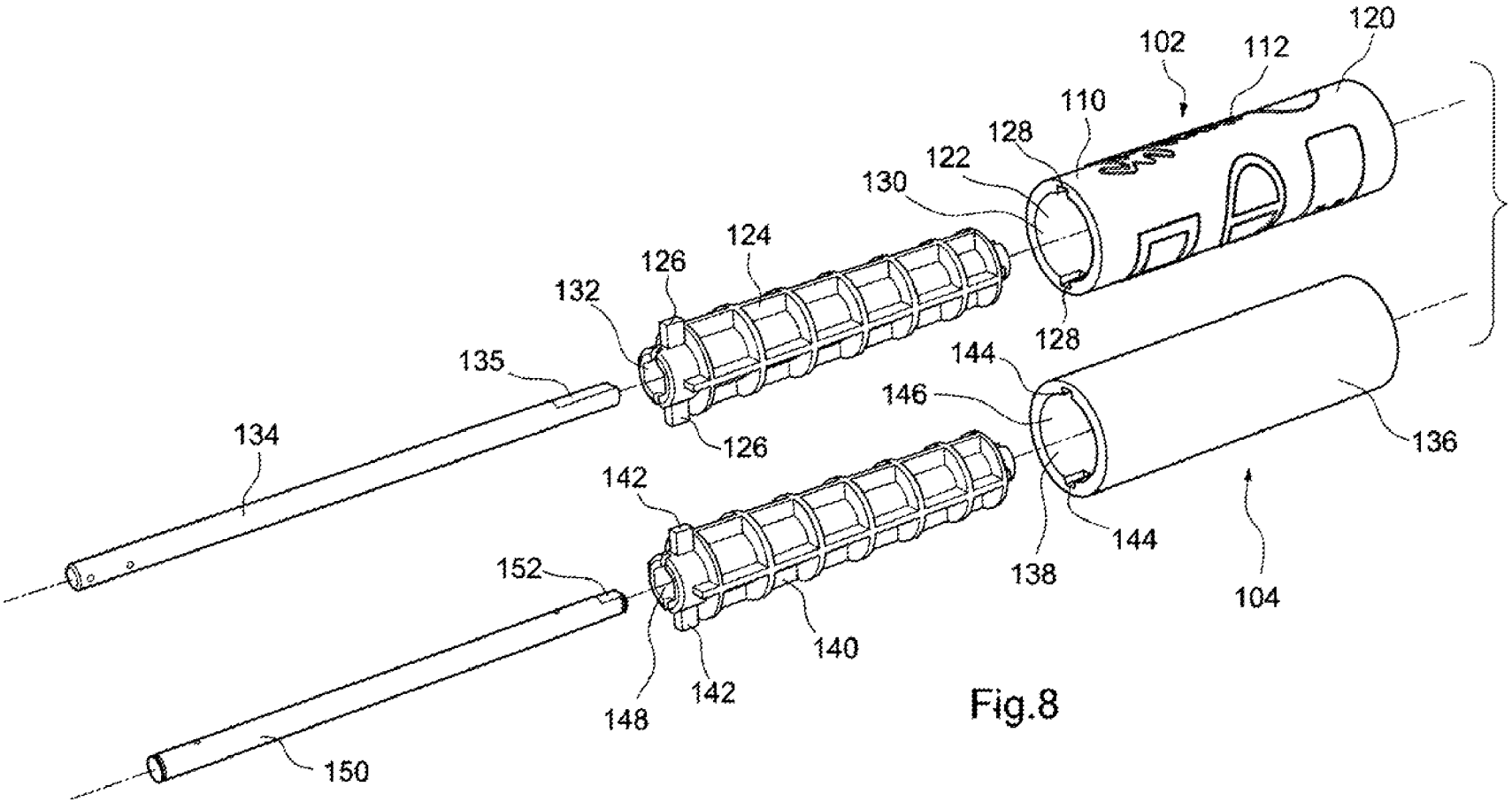
FIG. 8 shows exploded views of the cutting roller and the support roller of the apparatus of FIG. 1.

Using the apparatus 100 for further illustration below, the structure of the cutting roller 102 and that of the support roller 104 are shown in FIG. 8. The cutting roller 102 has a metal or metal alloy outer tube 120 on the outer cylindrical surface 110 of which are formed the closed-loop cutting edges 112. The tube 120 has a hollow interior 122 for receiving a generally cylindrical plastics reinforcement member 124. The reinforcement member 124 has two diametrically opposed fingers 126 for engagement with two correspondingly sized, configured and positioned recesses 128 on an interior surface 130 of the tube 120, such that the tube 120 and the reinforcement member 124 are engaged for simultaneous rotational movement. The reinforcement member 124 has a longitudinal channel 132 for receiving an elongate rod 134. A cut portion 135 is formed at one longitudinal end of the rod 134, the function of which will be discussed below.

Similarly, the support roller 104 has an outer tube 136 with a hollow interior 138 for receiving a generally cylindrical plastics reinforcement member 140. The reinforcement member 140 has two diametrically opposed fingers 142 for engagement with two correspondingly sized, configured and positioned recesses 144 on an interior surface 146 of the tube 136, such that the tube 136 and the reinforcement member 140 are engaged for simultaneous rotational movement. The reinforcement member 140 has a longitudinal channel 148 for receiving an elongate rod 150. A cut portion 152 is formed at one longitudinal end of the rod 150, the function of which will be discussed below.

Figure 9:
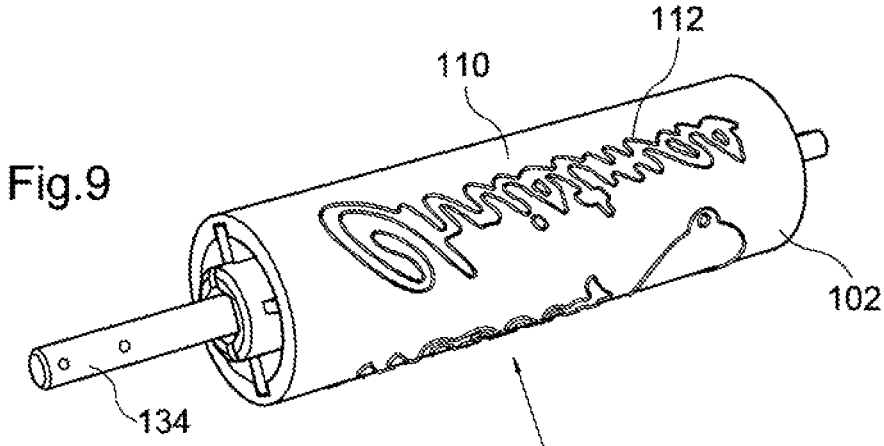
FIG. 9 is a perspective view of the cutting roller of the apparatus of FIG. 1.
Figure 10:
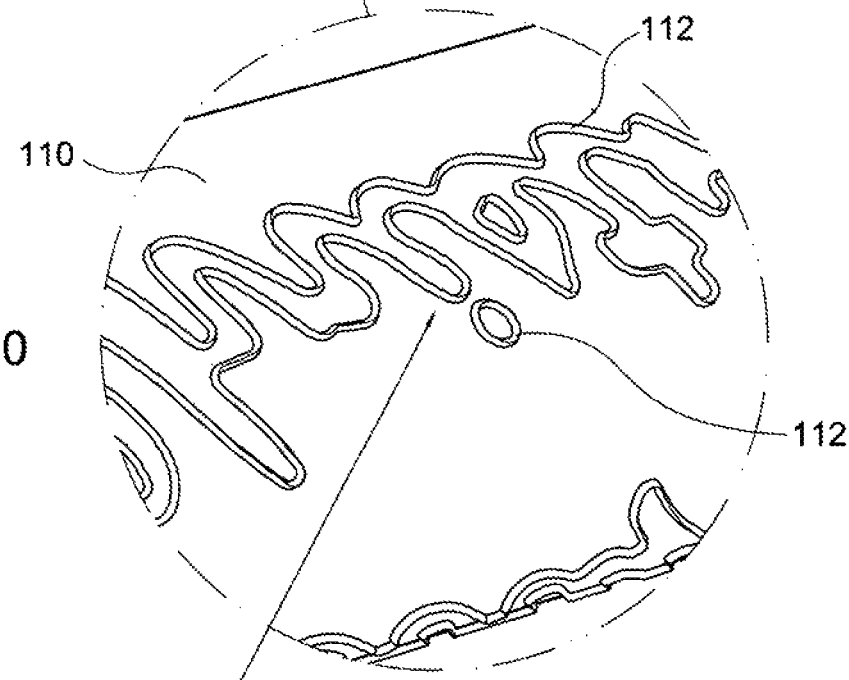
FIG. 10 is an enlarged view of the cutting ridge on the cutting roller of FIG. 9.
Figure 11:
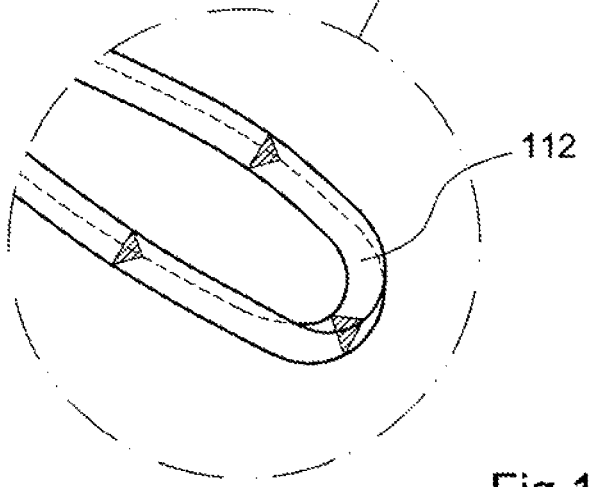
FIG. 11 is a further enlarged view of the cutting ridge shown in FIG. 10.

As shown in FIGS. 9 to 11, a number of continuous closed-loop cutting ridges 112 are formed on the outer cylindrical surface 110 of the cutting roller 102. In order to ensure that the cut pieces of patterned paper or cardboard are detachable from the piece of paper or cardboard 114, there are no open-ended cutting ridges.

As shown in FIGS. 12 to 14B, the cut portion 135 of the rod 134 is engaged with the gear 108 such that rotation of the gear 108 (e.g. upon rotational movement of the handle 106) will bring the reinforcement member 124 and the outer tube 120 into simultaneous rotational movement.

As shown in FIGS. 15 and 16, the outer tube 120 of the cutting roller 102 with patterned ridges 112 may be formed by way of low pressure die cast in a multi-sector mould piece 160, so as to allow formation of more complex patterns in every direction of the outer tube 120. Upon release of the outer tube 120 from the mould piece (as shown in FIG. 17), the radial end 162 of the patterned ridges 112 are flat.

Figure 19:
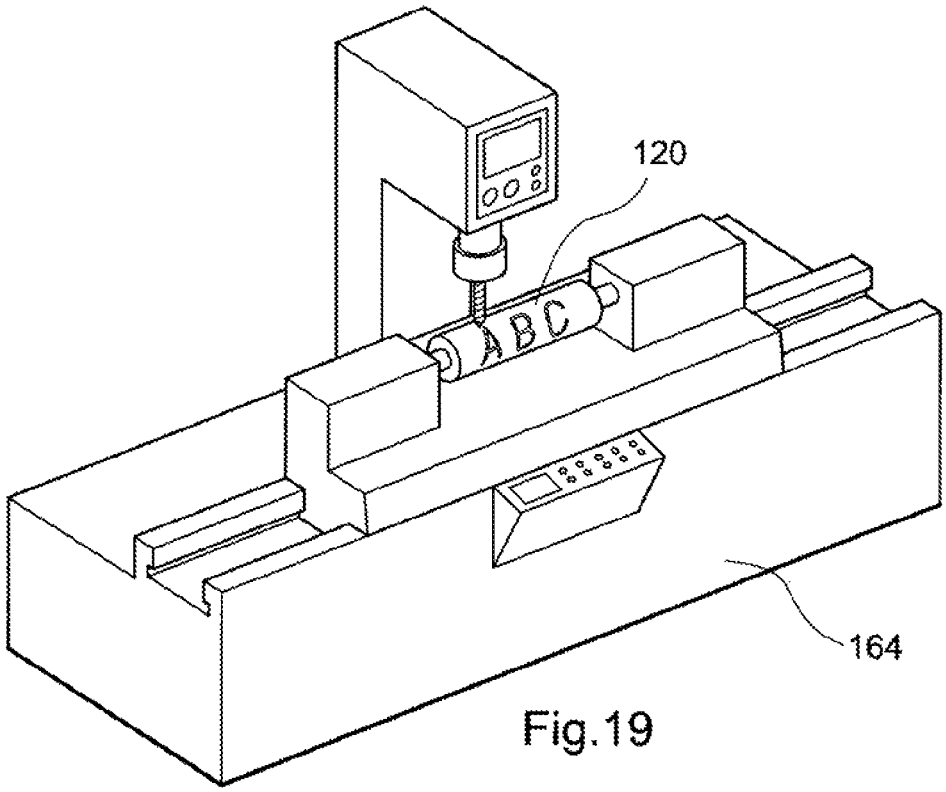
FIG. 19 shows machining of the cutting roller of FIG. 18A by a computerized numerical controlled sculpturing machine.
Figure 20:
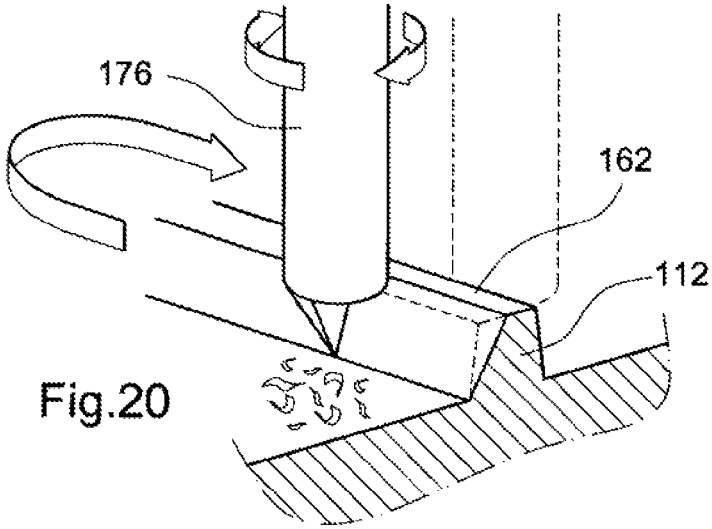
FIG. 20 is an enlarged view of part of FIG. 19 showing formation of a cutting ridge.
Figure 21:
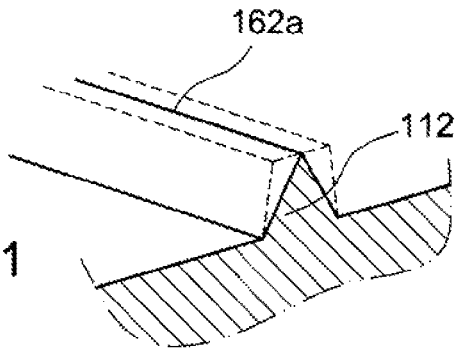
FIG. 21 shows the cutting ridge after formation.

The outer tube 120 is then positioned in a computerized numerical controlled sculpturing machine 164 further machining (see FIG. 19). In particular, as shown in FIG. 20, the radial end 162 of the ridge 112 is machined by the sculpturing machine 164 on two sides into a sharp edge 162*a*, as shown in FIG. 21.

Figure 22:
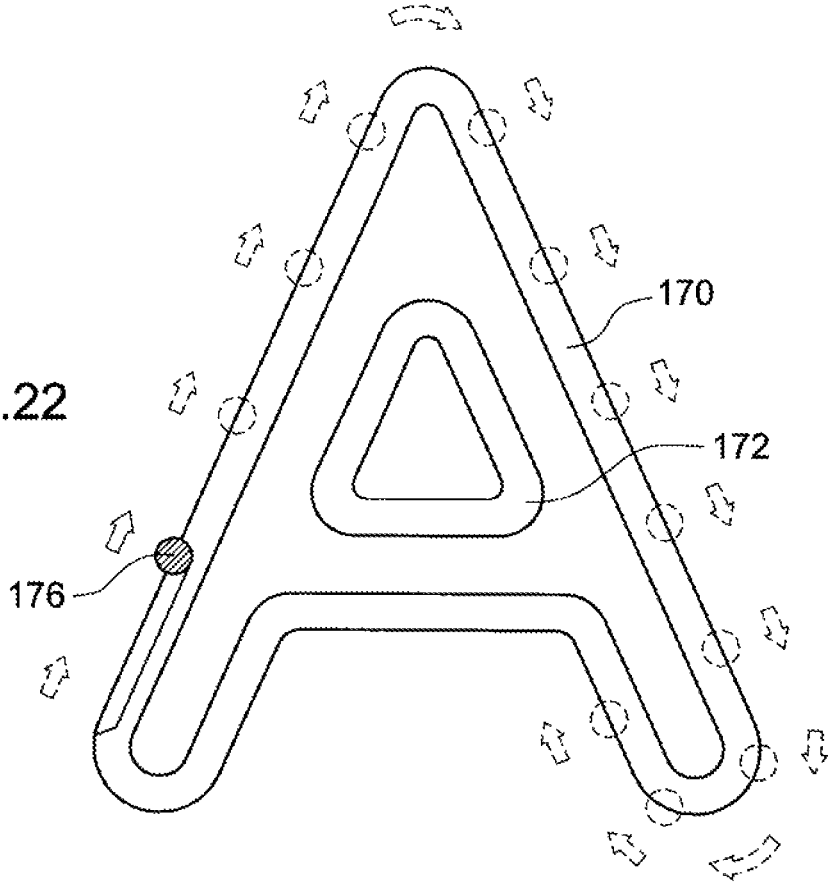
FIG. 22 shows schematically the formation of a cutting ridge on a cutting roller.
Figure 23:
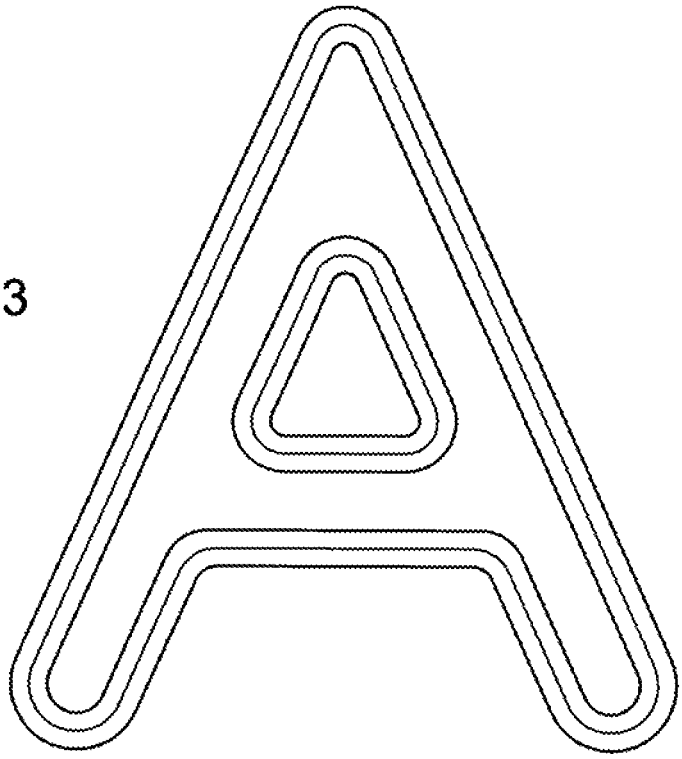
FIG. 23 shows schematically the cutting ridge as formed.

Using a pattern in the form of the alphabet "A" as an example, an outer continuous closed-loop ridge 170 and an inner continuous closed-loop ridge 172 are formed on the outer tube 120 in the mould piece 160 (as shown in FIG. 22). A cutting tool 176 of the computerized numerical controlled sculpturing machine 164 then cuts each of the ridges 170, 172 into a sharp cutting ridge (as shown in FIG. 23) with a triangular cross-section (see FIG. 21).

It should be pointed out that the cutting roller 102 may be formed by other methods, e.g. powder formation.

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

The invention claimed is:

1. A paper cutting apparatus including:

a cylindrical cutting member with at least one closed-loop cutting ridge on its outer cylindrical surface; and a support member;

wherein said cutting member is rotatable relative to said support member to move a piece of material relative to and between said cutting member and said support member to cut out part of said piece of material passing therebetween;

wherein said cylindrical cutting member includes an outer tube having a hollow interior which receives an inner reinforcement member; and wherein said reinforcement member has two diametrically opposed fingers engaged with two recesses on an interior surface of said tube, said tube and said reinforcement member being engaged with each other for simultaneous rotational movement;

wherein said support member has an interior cavity which receives a reinforcement member; and, wherein said support member further includes an outer tube, and wherein said reinforcement member of said support member has two diametrically opposed fingers engaged with two recesses on an interior surface of said outer tube of said support member, said tube and said reinforcement member being engaged with each other for simultaneous rotational movement.

2. An apparatus according to claim 1 wherein said cutting member is rotatable by a handle member.

3. An apparatus according to claim 1 wherein said support member is a roller.

4. An apparatus according to claim 3 wherein said roller is rotatable in response to rotation of said cutting member.

5. An apparatus according to claim 4 wherein said cutting member is engaged with a gear member which is in mesh with a gear member engaged with said roller.

6. An apparatus according to claim 4 wherein said cutting member and said roller are adapted to rotate in opposite directions.

7. An apparatus according to claim 1 wherein said cutting member has an interior cavity engaged with said reinforcement member.

8. An apparatus according to claim 1 wherein said reinforcement member of said cutting member includes a longitudinal channel, a rod member received within the channel.

9. An apparatus according to claim 8 wherein said rod member is engaged with said reinforcement member of said cutting member for simultaneous rotational movement therewith.

10. An apparatus according to claim 8 wherein said rod member is engaged with a first gear member which is in mesh with a second gear member engaged with said support member.

11. An apparatus according to claim 10 wherein said rod member is engaged with said first gear member for simultaneous rotational movement therewith.

* * * * *